US005839376A

United States Patent [19]

Barlow

[11] Patent Number: 5,839,376

[45] Date of Patent: Nov. 24, 1998

[54] STOKER WITH UNIVERSAL KEY CONSTRUCTION

[75] Inventor: Dennis N. Barlow, Enfield, Conn.

[73] Assignee: Combustion Engineering, Inc., Windsor, Conn.

[21] Appl. No.: 578,008

[22] Filed: Dec. 22, 1995

[51] Int. Cl.[6] ..... F23H 11/00

[52] U.S. Cl. ..... 110/270; 110/330; 110/274

[58] Field of Search ..... 110/269, 270, 110/274, 330, 329, 165 R

[56] References Cited

U.S. PATENT DOCUMENTS

| | | | |
|---|---|---|---|
| 4,308,034 | 12/1981 | Hoang | 110/270 X |
| 5,361,892 | 11/1994 | Hamaker et al. | 110/269 X |
| 5,551,356 | 9/1996 | Post | 110/269 |

*Primary Examiner*—Henry A. Bennett
*Assistant Examiner*—Susanne C. Tinker
*Attorney, Agent, or Firm*—Robert S. Smith

[57] ABSTRACT

An individual key, a stoker incorporating a plurality of the keys, or a furnace incorporating the stoker which includes a key apparatus having a mounting surface dimensioned and configured for sliding engagement with an associated arm, the mounting surface is disposed on the bottom of the key, an upper face receives associated fuel to be burned, a first side having a first contour, and a second side having a second contour. The second contour is different than the first contour. In some forms of the invention the first contour and the second contour are dimensioned and configured for meshing engagement whereby a first side of a first key will mesh with a second side of a second key when a plurality of the identical keys are arrayed in side abutting relationship. The first contour may includes a first lip and the second contour may include a second lip and the the first lip may be disposed at a different elevation than the second lip. In some cases the entire extent of the first lip is at a different elevation than the entire extent of the second lip. At least one of the lips may include indentations to allow airflow for cooling and combustion.

19 Claims, 2 Drawing Sheets

STOKER WITH UNIVERSAL KEY CONSTRUCTION

TECHNICAL FIELD

The invention has particular application to steam generating apparatus and particularly to stokers. Modern stokers are mechanical devices which feed and burn solid fuels in a bed at the bottom of a furnace. In all cases, the fuel is burned on some form of grate, through which some or all of the air for combustion passes. The grate surface in the stationary or moving. Stokers are classified according to the way fuel is fed to the grate. The three general classes in use today are underfeed stokers, overfeed stokers, and spreader stokers.

The present invention has primary application to spreader stokers and particularly to the most popular type of spreader stokers. This type is a continuous ash discharge (CAD) grate. The spreader stoker combines the principles of suspension burning and thin-bed combustion. Feeder/distributor devices continuously project fuel into the furnace above an ignited fuel bed on the grate. Fines are burned in suspension while larger particles fall and burn on the grate.

The spreader stoker method of fuel firing provides quick response to changes in boiler demand, and generally never has more than a few minutes of fuel inventory on the grate. The most popular type of spreader stoker is that incorporating the continuous ash discharge grate. This grate is somewhat like the track of a military tank and it has a continuous chain of surfaces that moves toward the fuel feeders, which are throwing new fuel towards the back of the unit. All the fuel is burned before reaching the front end, from which ash is continuously dumped. The return side of the grate carries siftings, which fall through the top side, to the back end and discharges them into a hopper. The grate speed is regulated to maintain an ash bed of 2 inches to 4 inches at the discharge. Typical operating speed ranges are from 2 to 4 feet/hour. The operating speed is varied by means of gear or hydraulic drive units.

The stoker grate surface is usually composed of discrete sections. Each section of the grate surface may be visualized as a continuous "chain" of interconnected laterally elongated bar and key assemblies. Each section is a separate "chain". The continuous "chain" has the overall look of a wide continuous belt or military tank tread carried on two spaced rollers. In other words, usually a plurality of such continuous "chains" of interconnected laterally elongated keys are disposed in side abutting relation. Thus, the overall surface area of the grate surface is the sum of the individual upper areas of the plurality of continuous "chains" of interconnected laterally elongated bar and key assemblies disposed in side abutting relation. Additional description of conventional stoker construction is provided in the handbook entitled Combustion Fossil Power, edited by Joseph G. Singer, P. E. and published by ABB Combustion Engineering, Inc. of Windsor, Conn.

Continuous ash discharge stokers are used for a wide variety of applications. They inherently are capable of firing even caking-type coals without concern about matting or clinkering. Practically all types of coal (except anthracite) and a wide variety of cellulose fuels, including wood wastes, bagasse, furfural residue sludge, rice hulls, and coffee grounds have been successfully burned on spreader stokers. The wood wastes may include the bark of trees. One application is in paper mills where the bark is a by-product of the paper making process. In such applications the bark is burned to produce steam.

The stokers used for such applications have customarily incorporated a number of overlap keys and an equal number of underlap keys on each of a plurality of arms. The arm and key assemblies are laterally extending metallic members in an assembly, somewhat like a bicycle drive chain, in which the keys correspond generally to the links of the bicycle chain. As on a bicycle the continuous "chain" is mounted on two spaced sprockets.

The known prior art overlap keys have been characterized by laterally extending lips on each side that are disposed to overlap a laterally extending lip on each of two adjacent underlap keys. Thus, the prior art apparatus comprises a plurality of sets of an underlap key having laterally extending ribs offset so as to be nearer the bottom of the key and an overlap key having laterally extending ribs offset so as to be nearer the top of the key. The ribs on adjacent keys are fixed in abutting relationship during assembly and maintain their fixed overlapping relationship once the assembly is complete.

The prior art design requires the manufacture to tool up for two different key constructions and to maintain inventories of two different key constructions.

Similarly, the prior art design requires the user to maintain inventories of two different key constructions and to sequentially assemble sets of underlap and overlap keys. The difficulty of sorting underlap and overlap keys is related to the size, weight and number of the keys. A typical key weighs approximately 2.5 pounds and is approximately 12 inches long. A typical continuous ash discharge stoker will have between 10,000 and 15,000 keys. Obviously, the weight, size and number of keys will vary with the specific application. Typical stokers are 11 to 24 feet wide and 15 to 28 feet long.

It will be further understood that the assembly operation is not merely a one time occurrence at the time of initial assembly. The stoker requires periodic maintenance and this requires disassembly of the stoker and removal of all the keys. More specifically, the typical stoker will have a yearly minor rebuild during which 10% of the keys are replaced. The typical stoker will have a major rebuild every five years and this will require replacement of all of the keys. This frequency of replacement coupled with the very large number of such keys makes it particularly desirable to improve the design of the keys.

OBJECTS AND SUMMARY OF THE INVENTION

It is an object of the present invention to provide apparatus that will eliminate the need to manufacture discrete overlap and underlap keys for use in continuous ash discharge stokers.

Another object of the invention is to provide apparatus that will eliminate the need for sequentially assembling sets of overlap and underlap keys as well as eliminating the need for the user to inventory both overlap and underlap keys.

It is another object of the invention to provide apparatus that will incorporate only a single universal shape key.

Still another object of the invention is to provide apparatus that may be manufactured more inexpensively than the known overlap and underlap keys.

Yet another object of the invention is to provide apparatus that will achieve economies of scale in the manufacturer of the key as the result of requiring the manufacture of only a single universal key.

It has now been found that these and other objects of the invention may be attained in either an individual key, a stoker incorporating a plurality of the keys, or a furnace incorporating the stoker which includes a key apparatus having a mounting surface dimensioned and configured for sliding engagement with an elongated arm, a mounting surface is disposed on the bottom of the key; an upper face for receiving associated fuel to be burned; a first side having a first contour; and a second side having a second contour. The second contour is different than the first contour.

In some forms of the invention the first contour and the second contour are dimensioned and configured for meshing engagement whereby a first side of a first key will mesh with a second side of a second key when a plurality of the identical keys are arrayed in side abutting relationship. The first contour may include a first lip and the second contour may include a second lip and the first lip may be disposed at a different elevation than the second lip. In some cases the entire extent of the first lip is at a different elevation than the entire extent of the second lip. At least one of the lips may include indentations to allow airflow for cooling and combustion.

BRIEF DESCRIPTION OF THE DRAWING

The invention will be better understood by reference to the accompanying drawing in which.

DESCRIPTION OF THE PREFERRED EMBODIMENT

Figure 1:
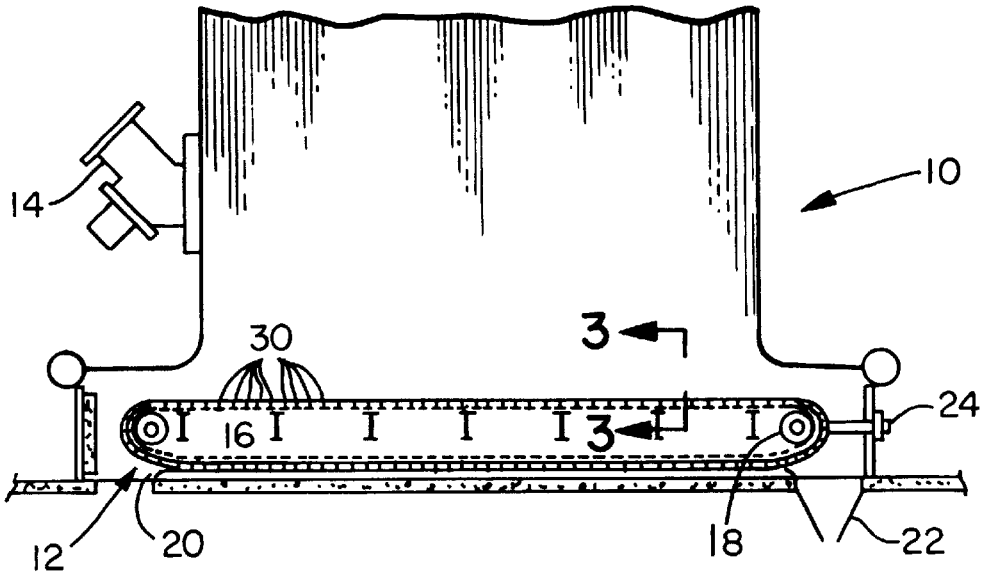
FIG. 1 is a sectional view taken along a vertical plane of a furnace incorporating a continuous ash discharge stoker in accordance with the present invention.

Referring now to FIG. 1, there is shown a steam generating furnace end incorporating a spreader stoker with a continuous ash discharge grate 12. The grate 12 is disposed at the bottom of the furnace 10. A fuel distributor 14 directs the fuel onto the upper surface of the grate 12. In a typical apparatus the fuel is distributed pneumatically onto the grate 12 near the right side (as viewed) of the upper surface of the grate 12. The grate 12 moves counter-clockwise about the surface 16, 18. The grate 12 is supported by return rails 20. The apparatus also includes a siftings hopper 22 and a take-up 24. The sprocket 16 is mounted on a drive shaft and the sprocket 18 is mounted on an idler shaft. It will be understood that the FIG. 1 is a very simplified schematic.

Figure 2:
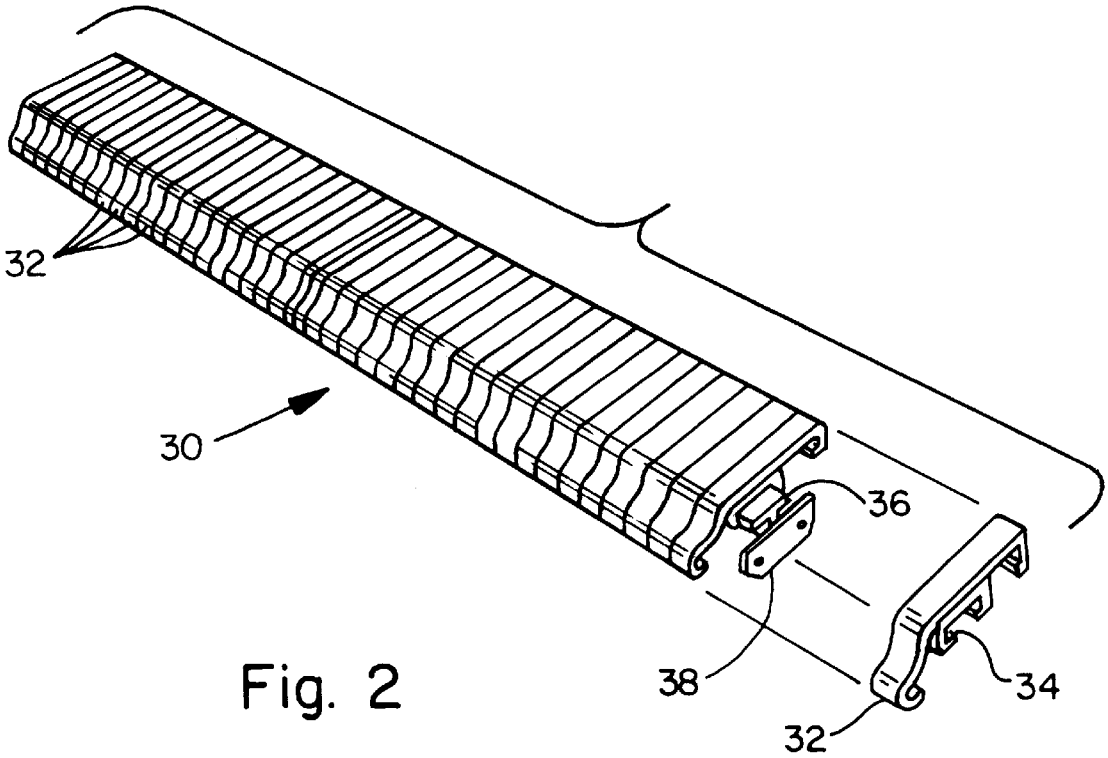
FIG. 2 is a partially exploded perspective view of a bar and key grate assembly in the continuous ash discharge stoker illustrated in FIG. 1.

Referring now to FIG. 2, there is shown one arm and key assembly 30. The grate 12 is a continuous "chain" of interconnected laterally elongated bar and key assemblies 30. Only one end of these assemblies 30 is visible in the view of FIG. 1. It will be understood that the grate 12 includes dozens of these assemblies 30. Each arm and key assembly 30 includes a plurality of side abutting keys 32 that are each provided with a channel 34 that is dimensioned and configured for sliding engagement with a plate 36 that is part of the arm 38 on which the plurality of keys 32 are assembled.

Figure 3A:
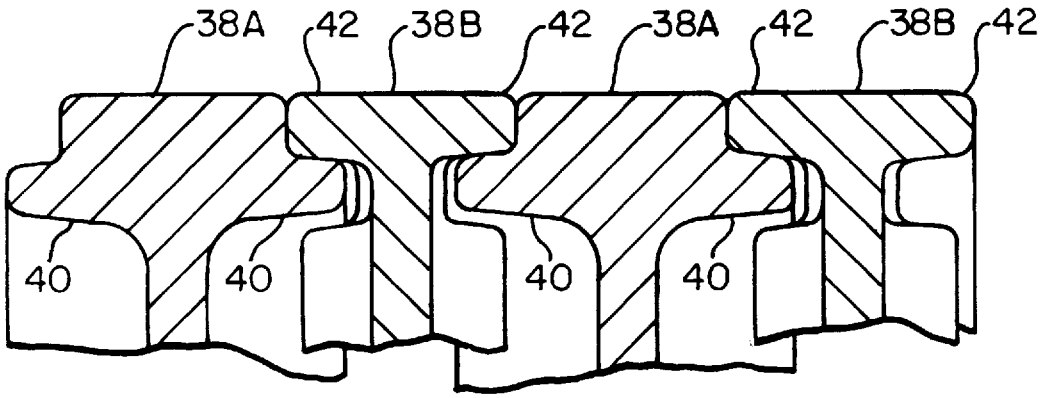
Fig. 3A (PRIOR ART)
FIG. 3A is a fragmentary sectional view of the meshing portions of laterally adjacent keys in a prior art bar and key assembly.
Figure 3B:
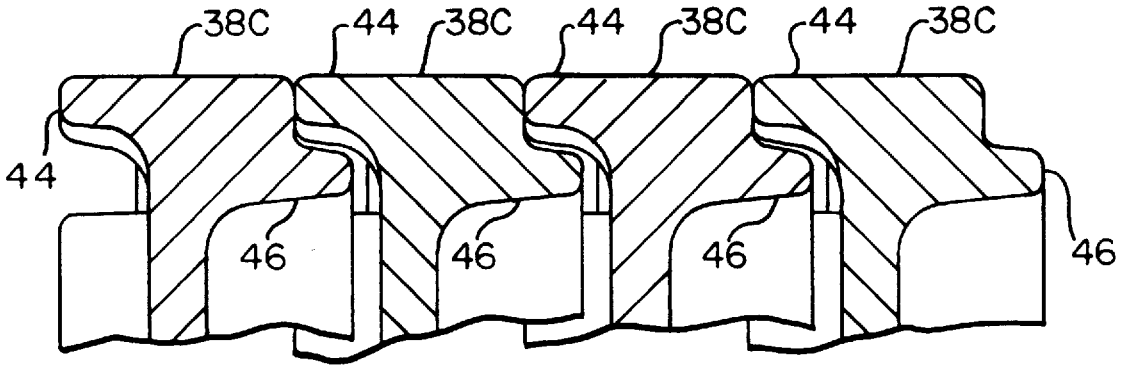
FIG. 3B is a view, similar to that of FIG. 3A, which is a fragmentary sectional view of the meshing portions of laterally adjacent keys in a bar and key assembly in accordance with the present invention.

The invention will be best understood by a comparison between the prior part apparatus and the apparatus of the present invention. The views of FIGS. 3A and 3B are each fragmentary cross sectional views taken along the line 3—3 of FIG. 1. Those skilled in the art will recognize that the line 3—3 corresponds to a vertical plane extending through the keys 32 that is perpendicular to the planar plate 36. It will be understood that the differences between the structure shown in FIGS. 3A and 3B are visible only in those Figures. In other words, neither meshing relationship between the adjacent keys in the prior art structure or the illustrated embodiment of the present invention is visible in FIG. 2.

It will be further understood that the key 32 construction in the preferred embodiment of the present invention enables the use of a single uniform key in place of alternating underlap and overlap keys and that the uniform keys will function with the same arm 38. For convenience in describing the apparatus the numeral 38 will be used to describe the basic, individual key. When referring to specific prior art key constructions the reference numeral 38A and 38B will be used. Similarly, in describing specific aspects of the invention the numeral 38C will be used.

The prior art utilizes alternating underlap keys 38A and overlap keys 38B. The known prior art overlap keys 38B are characterized by laterally extending lips 42 on each side that are disposed to overlap a laterally extending lip 40 on each of two adjacent underlap keys 38A. More particularly, the keys 38 are elongated as best seen in FIG. 2. The respective laterally extending lips 40 are offset with respect to the laterally extending lips 42. More particularly the lips 42 have a face thereof that is coextensive with the face of the grate 12. The lips 40 have all parts thereof disposed further from the face of the grate 12 than any part of the lips 42. Furthermore, the lips 40, 42 are dimensioned and configured for meshing engagement. Thus, the prior art apparatus comprises a plurality of sets of underlap keys 38A having laterally extending ribs 40 offset so as to be nearer the bottom of the key and an overlap keys 38B having laterally extending ribs 42 offset so as to be nearer the top of the key 38B. The ribs on adjacent keys are positioned in abutting relationship during assembly. The assembled pieces permit essentially no relative motion between abutting keys. Thus, the keys maintain their fixed overlapping relationship once the assembly is complete.

Referring now to FIG. 3B there is shown the unique portion of the key 38C in accordance with one form of the present invention. Each arm and key assembly 30 in accordance with the present invention includes a plurality of identical keys 38C keys disposed in side abutting relationship. Each key 38C includes an upper laterally extending lip 44 and a lower laterally extending lips 46. All parts of the lower laterally extending ribs are below all parts of the upper laterally extending lips 44. In other words, the laterally extending lips 46 are offset with respect to the laterally extending lips 44. The lower (as viewed) part of each lip 44 is provided with an indentation to allow airflow for cooling and combustion.

The invention has been described with reference to its illustrated preferred embodiment. Persons skilled in the art of such devices may upon disclosure to the teachings herein, conceive other variations. Such variations are deemed to be encompassed by the disclosure, the invention being delimited only by the following claims.

Having thus described my invention, I claim:

1. A key apparatus for installation on an associated arm of an associated continuous ash discharge stoker which comprises:

a mounting surface dimensioned and configured for sliding engagement with the associated arm, said mounting surface being disposed on the bottom of said key;

an upper face for receiving associated fuel to be burned;

a first side having a first contour; and a second side having a second contour, said second contour being different than said first contour said first contour being dimensioned and configured for meshing engagement with said second contour on another associated key apparatus having an identical shape disposed in side abutting relationship.

2. The apparatus as described in claim 1 wherein:

said first contour includes a first lip.

3. The apparatus as described in claim 2 wherein;

said second contour includes a second lip.

4. The apparatus as described in claim 3 wherein;

said first lip is disposed at a different elevation than said second lip.

5. The apparatus as described in claim 4 wherein:

the entire extent of said first lip is at a different elevation than the entire extent of said second lip.

6. The apparatus as described in claim 5 wherein:

at least one of said lips includes indentations to allow airflow for cooling and combustion.

7. A continuous ash discharge stoker apparatus which comprises:

first and second sprockets;

a continuous track interconnected elongated arm and key assemblies;

each arm and key assembly including an arm having an elongated mounting flange that extends laterally across substantially the width of said track;

each arm and key assembly including a plurality of keys, each key in said plurality of keys including a mounting surface dimensioned and configured for sliding engagement with said arm, said mounting surface being disposed on the bottom of said key;

each key in said plurality of keys having an upper face for receiving associated fuel to be burned;

each key in said plurality of keys having a first side having a first contour; and each key in said plurality of keys having a second side having a second contour, said second contour being different than said first contour.

8. The apparatus as described in claim 7 wherein:

said first contour and said second contour are dimensioned and configured for meshing engagement whereby a first side of a first key will mesh with a second side of a second key when a plurality of said identical keys are arrayed in side abutting relationship.

9. The apparatus as described in claim 8 wherein:

said first contour includes a first lip.

10. The apparatus as described in claim 9 wherein;

said second contour includes a second lip.

11. The apparatus as described in claim 10 wherein;

said first lip is disposed at a different elevation than said second lip.

12. The apparatus as described in claim 10 wherein:

the entire extent of said first lip is at a different elevation than the entire extent of said second lip.

13. The apparatus as described in claim 12 wherein:

at least one of said lips includes indentations to allow airflow for cooling and combustion.

14. A furnace apparatus which comprises:

walls defining a combustion chamber;

a continuous ash discharge stoker disposed in said chamber;

said continuous ash discharge stoker including first and second sprockets; a continuous track interconnected elongated arm and key assemblies; each arm and key assembly including an arm having an elongated mounting flange that extends laterally across substantially the with of said track; each arm and key assembly including a plurality of keys, each key in said plurality of keys being identical and including a mounting surface dimensioned and configured for sliding engagement with said arm, said mounting surface being disposed on the bottom of said key; each key in said plurality of keys having an upper face for receiving associated fuel to be burned; each key in said plurality of keys having a first side having a first contour; and each key in said plurality of keys having a second side having a second contour, said second contour being different than said first contour.

15. The apparatus as described in claim 14 wherein:

said first contour and said second contour are dimensioned and configured for meshing engagement whereby a first side of a first key will mesh with a second side of a second key when a plurality of identical keys are arrayed in side abutting relationship.

16. The apparatus as described in claim 15 wherein:

said first contour includes a first lip.

17. The apparatus as described in claim 16 wherein;

said second contour includes a second lip.

18. The apparatus as described in claim 17 wherein;

said first lip is disposed at a different elevation than said second lip.

19. The apparatus as described in claim 18 wherein:

the entire extent of said first lip is at a different elevation than the entire extent of said second lip.

* * * * *